United States Patent [19]

Kinoshita et al.

[11] Patent Number: 5,043,085

[45] Date of Patent: Aug. 27, 1991

[54] GREASE COMPOSITION CONTAINING UREA, UREA-URETHANE, OR URETHANE THICKENERS

[76] Inventors: Hirotugu Kinoshita, 203, Kitsukidaimachi, Nakahara-ku, Kawasaki-shi, Kanagawa-ken; Makoto Sekiya; Masaru Mishima, both of 2-228, Kosugicho, Nakahara-ku, Kawasaki-shi, Kanagawa-ken, all of Japan

[21] Appl. No.: 486,963

[22] Filed: Mar. 1, 1990

[30] Foreign Application Priority Data

Mar. 4, 1989 [JP] Japan ..... 1-50997

[51] Int. Cl.[5] ..... C10M 45/00; C10M 119/14

[52] U.S. Cl. ..... 252/49.9; 252/49.8; 252/51.5 R; 252/55; 252/51.5 A

[58] Field of Search ..... 252/515 R, 49.8, 49.9, 252/51.5 A

[56] References Cited

U.S. PATENT DOCUMENTS

| | | | |
|---|---|---|---|
| 2,710,839 | 6/1955 | Swakon et al. | 252/49.9 |
| 3,082,168 | 3/1963 | Rue et al. | 252/55 |
| 3,095,375 | 6/1963 | Pitman | 252/55 |
| 3,309,317 | 3/1967 | Wittner et al. | 252/49.9 |
| 3,459,660 | 8/1969 | Shepherd | 252/49.8 |
| 3,725,279 | 4/1973 | Armstrong | 252/51.5 A |
| 3,766,070 | 10/1973 | Wulfers | 252/51.5 A |
| 3,766,071 | 10/1973 | Wulfers | 252/51.5 A |
| 4,065,395 | 12/1977 | Bailey | 252/51.5 A |
| 4,102,797 | 7/1978 | Schadenberg | 252/51.5 A |
| 4,115,284 | 9/1978 | Kinoshita et al. | 252/51.5 A |
| 4,780,231 | 10/1988 | Kinoshita et al. | 252/51.5 A |

*Primary Examiner*—Prince E. Willis
*Assistant Examiner*—Ellen McAvoy
*Attorney, Agent, or Firm*—Majestic, Parsons, Siebert & Hsue

[57] ABSTRACT

A grease composition comprises a base oil selected from the group consisting of mineral lubricant base oils, synthetic lubricant base oils and mixtures thereof, (A) 2 to 25 wt %, based on the total weight of the composition, of a thickener selected from the group consisting of urea compounds, urea-urethane compounds, urethane compounds and mixtures thereof and (B) 0.2 to 5.0 wt. %, based on the total weight of the composition, of an ingredient selected from the group consisting of oxidized paraffins, diphenylhydrogen phosphite, hexamethyl phosphoric triamide and mixtures thereof.

21 Claims, No Drawings

GREASE COMPOSITION CONTAINING UREA, UREA-URETHANE, OR URETHANE THICKENERS

BACKGROUND OF THE INVENTION

The present invention relates to a grease composition, and more particularly to a grease composition for preventing fretting at sliding or joint portions of parts used for constraining relative motions or parts bearing fine reciprocating motions.

There are various mechanical parts which are suffering from abrasion referred to as fretting, examples of such mechanical parts being parts for restraining relative motions, for example, shaft engagement, bolt joint, rivet joint or tapered joint, and parts bearing fine reciprocating motions, for example, ball-and-roller bearing, plain bearing, ball bush, spline shaft, flexible shaft joint, universal joint, laminated spring, coil spring, electric contact, valve and valve seat or wire rope. Particularly, for transportation of motor cars, long distance transportation has been carried out by trailers or freight trains. During such long distant transportation, rolling surfaces of bearings are suffering from fretting by fine vibration to thereby arise a problem.

Various methods have been proposed to prevent such fretting, including a method in which a properly selected lubricant is used to prevent fretting. Prevention of fretting by grease lubrication has been reported. However, different results were found for thickners as test methods are varied. Additives containing phosphates have been found to exhibit advantageous effects, but the effects are significantly affected by chemical structure of the additives. The performance characteristics of a particular grease for the prevention of fretting have not yet been sufficiently clarified.

On the other hand, we have found a urea grease composition which is improved in various properties, and patent applications were filed therefor (see Japanese Patent Publication No. 11156/1980 and Japanese Laid-open Patent Application Nos. 250097/1987 and 9296/1989).

After eager investigation, we have found that a grease composition containing a urea thickener to which there is added a specific compound is considerably improved in fretting prevention capacity as compared to the conventional grease compositions.

SUMMARY OF THE INVENTION

An object of this invention is to provide a grease composition having improved properties to prevent fretting when applied to sliding or joining portions of parts for constraining relative motions or for bearing fine reciprocal movements.

With the aforementioned object in view, the present invention provides a grease composition comprising:

a base oil selected from the group consisting of mineral lubricant base oils, synthetic lubricant base oils and mixtures thereof;

(A) 2 to 25 wt %, based on the total weight of the composition, of a thickener selected from the group consisting of urea compounds, urea-urethane compounds, urethane compounds and mixtures thereof; and (B) 0.2 to 5.0 wt %, based on the total weight of the composition, of an ingredient selected from the group consisting of oxidized paraffins, diphenylhydrogen phosphite, hexamethyl phosphoric triamide and mixtures thereof.

DESCRIPTION OF THE INVENTION

The present invention will be described in further detail.

Any of the conventionally known mineral and/or synthetic lubricant oils may be used as a base oil in this invention. Examples of mineral lubricant base oils, which may be used in this invention, include those refined by the combination of distillation under reduced pressure, solvent deasphalting, solvent extraction, hydrogenolysis, solvent dewaxing, hydrogenation dewaxing, sulfuric acid treatment, clay treatment and hydrogenation refinement. Specific examples of mineral lubricant base oils include SAE10, SAE20, SAE30, SAE40, SAE50 and bright stock.

Specific examples of synthetic lubricant base oils include α-olefin oligomers such as normal paraffin, isoparaffin, polybutene, polyisobutyrene or 1-decene oligomer; alkylbenzenes such as monoalkylbenzene, dialkylbenzene or polyalkylbenzenes; alkylnaphthalenes such as monoalkylnaphthalene, dialkylnaphthalene or polyalkylnaphthalene; diesters such as di-2-ethylhexyl sebacate, dioctyl adipate, diisodecyl adipate, ditridecyl adipate or ditridecyl glutarate; polyol esters such as trimethylolpropane caprylate, trimethylolpropane peralgonate, pentaerythritol-2-ethyl hexanoate or pentaerythritol pelargonate; polyglycols such as polyethyleneglycol, polyethyleneglycol monoether, or polypropyleneglycol monoether; polyphenyl ether, tricresyl phosphate, silicone oil and perfluoroalkyl ether. A mixture of two or more of the aforementioned oils may be used. Preferably, the mineral and/or synthetic lubricant base oils have a viscosity ranging within 10 to 200 cSt at 40° C.

The component (A) of the composition of this invention, i.e. the thickener selected from the group consisting of urea compounds, urea-urethane compounds, urethane compounds and mixtures thereof, may be any of the known diurea compounds, triurea compounds, tetraurea compounds, polyurea compounds, urea-urethane compounds or diurethane compounds which have been used as the thickeners for the grease compositions. A particularly preferable thickener used in the grease composition of this invention is a mixture containing at least one of the diurea compounds represented by the following formula:

$$R_2-NH\overset{O}{\overset{\|}{C}}NH-R_1-NH\overset{O}{\overset{\|}{C}}NH-R_3$$

wherein $R_1$ represents a difunctional aromatic hydrocarbon residue having 6 to 15 carbon atoms; and $R_2$ and $R_3$ may be the same or different and each stands for a cyclohexyl group, a group derived from the cyclohexyl and having 7 to 12 carbon atoms or an alkyl or alkenyl group having 8 to 20 carbon atoms;

the content of the cyclohexyl group or the group derived from the cyclohexyl, represented by [(number of the cyclohexyl groups or the groups derived from the cyclohexyl)/(number of the cyclohexyl group or the groups derived from the cyclohexyl plus number of the alkyl groups or the alkenyl groups)]×100, ranging within 20 to 90%, preferably from 45 to 75%, and more preferably the content of the diurea compound wherein $R_2$ is a cyclohexyl group or a group derived from the cyclohexyl and $R_3$ is an alkyl group or an alkenyl group being not less than 10 mol %. A further example of a particularly preferable thickener used in the grease composition of this invention is a mixture of at least two diurea compounds represented by the formula:

$$A-\overset{\overset{\displaystyle O}{\|}}{C}NH-R_4-NH\overset{\overset{\displaystyle O}{\|}}{C}-B$$

wherein $R_4$ stands for a difunctional aromatic hydrocarbon residue having 6 to 15 carbon atoms;

A and B may be the same or different and each stands for either one of a first amino group represented by the formula of $R_5$—NH— where $R_5$ is selected from the group consisting of a cyclohexyl group, a group derived from the cyclohexyl and having 7 to 12 carbon atoms or an alkyl group or alkenyl group having 8 to 20 carbon atoms, and a second amino group represented by the formula of $$\begin{matrix} R_6-N- \\ \diagup \\ R_7 \end{matrix}$$

where $R_6$ and $R_7$ may be the same or different and each stands for a cyclohexyl group or a group derived from the cyclohexyl and having 7 to 12 carbon atoms;

the content of the second amino group in the thickener, represented by [(number of the second amino groups/number of the first amino groups plus number of the second amino groups)×100] ranging within 1 to 50%, preferably from 5 to 40%; and the ratio between the first amino group wherein $R_5$ is a cyclohexyl group or a group derived from the cyclohexyl and the first amino group wherein $R_5$ is an alkyl group ranging from ¼ to 4/1, preferably from 3/7 to 7/3. A still further example of a particularly preferable thickener used in the grease composition of this invention is a urea-urethane mixuture having a composition including 20 to 05 mol %, preferably from 30 to 80 mol % of a diurea compound represented by the formula (1) of:

$$R_9NH-\overset{\overset{\displaystyle O}{\|}}{C}NH-R_8-NH\overset{\overset{\displaystyle O}{\|}}{C}-NHR_{10} \quad (1)$$

4 to 30 mol %, preferably from 10 to 30 mol % of a urea-urethane compound represented by the formula (2) of:

$$R_{12}NH-\overset{\overset{\displaystyle O}{\|}}{C}NH-R_{11}-NH\overset{\overset{\displaystyle O}{\|}}{C}-OR_{13} \quad (2)$$

and 1 to 50 mol %, preferably from 10 to 40 mol % of a diurethane compound represented by the formula (3) of:

$$R_{15}O-\overset{\overset{\displaystyle O}{\|}}{C}NH-R_{14}-NH\overset{\overset{\displaystyle O}{\|}}{C}-OR_{16} \quad (3)$$

wherein $R_8$, $R_{11}$ and $R_{14}$ may be the same or different and each represents a difunctional aromatic hydrocarbon residue having 6 to 15 carbon atoms, $R_9$, $R_{10}$ and $R_{12}$ may be the same or different and each represents a cyclohexyl group or a group derived from the cyclohexyl and having 7 to 12 carbon atoms, and $R_{13}$, $R_{15}$ and $R_{16}$ may be the same or different and each represents an alkyl or alkenyl group having 8 to 20 carbon atoms, the ratio of the number of amino groups $R_9NH$—, $R_{10}NH$— and $R_{12}NH$— to the number of alkoxy groups $R_{13}O$—, $R_{15}O$— and $R_{16}O$— in the mixture being 95/5 to 40/60, preferably 85/15 to 60/40.

The mixture as defined above but does not satisfy the numeral definition set forth above is disadvantageous when used as the thickener, since such a mixture is inferior in the properties for increasing the viscosity of the composition.

In the formulae set forth above, $R_1$, $R_4$, $R_8$, $R_{11}$ and $R_{14}$ may be the same or different, and each stands for a difunctional aromatic hydrocarbon residue having 6 to 15 carbon atoms. Preferable examples of $R_1$, $R_4$, $R_8$, $R_{11}$ and $R_{14}$ are as follows:

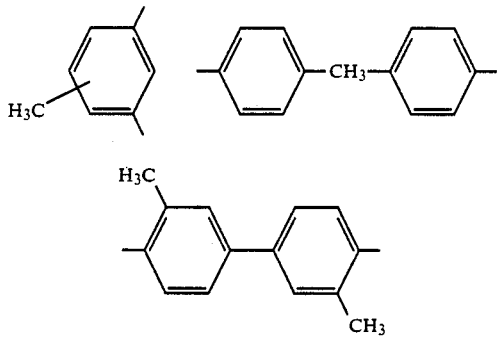

Other difunctional aromatic hydrocarbon residues may be used to exhibit improved properties, including high thermal stability and stability against oxidation.

In the formulae set forth above, $R_2$ and $R_3$ may be the same or different and each stands for a cyclohexyl group or a group derived from the cyclohexyl and having 7 to 12 carbon atoms, or an alkyl or alkenyl group having 8 to 20 carbon atoms. $R_5$ stands for a cyclohexyl group or a group derived from the cyclohexyl and having 7 to 12 carbon atoms, or an alkyl group having 8 to 20 carbon atoms. $R_6$, $R_7$, $R_9$, $R_{10}$ and $R_{12}$ may be the same or different and each stands for a cyclohexyl group or a group derived from the cyclohexyl and having 7 to 12 carbon atoms. $R_{13}$, $R_{15}$ and $R_{16}$ may be the same or different and each stands for an alkyl or alkenyl group having 8 to 20 carbon atoms. Specific examples of the cyclohexyl group or the group derived from the cyclohexyl and having 7 to 12 carbon atoms include cyclohexyl group, methylcyclohexyl group, dimethylcyclohexyl group, ethylcyclohexyl group, diethylcyclohexyl group, propylcyclohexyl group, isopropylcyclohexyl group, 1-methyl-3-propylcyclohexyl group, butylcyclohexyl group, amylcyclohexyl group, amylmethylcyclohexyl group and hexylcyclohexyl group, particularly preferred being cyclohexyl group or a group derived from the cyclohexyl and having 7 to 8 carbon atoms such as methylcyclohexyl group, dimethylcyclohexyl group or ethylcyclohexyl group.

Specific examples of the alkyl group having 8 to 20 carbon atoms include groups having straight-chain structure or branched-chain structure, such as octyl group, nonyl group, decyl group, undecyl group, dodecyl group, tridecyl group, tetradecyl group, pentadecyl group, hexadecyl group, heptadecyl group, octadecyl group, nonadecyl group and eicosyl group, particularly preferred being an alkyl group having 16 to 19 carbon atoms, such as hexadecyl group, heptadecyl group, octadecyl group or nonadecyl group.

Specific examples of the alkenyl group having 8 to 20 carbon atoms include groups having straight-chain structure or branched-chain structure, such as octenyl group, nonenyl group, decenyl group, undecenyl group, dodecenyl group, tridecenyl group, tetradecenyl group, pentadecenyl group, hexadecenyl group, heptadecenyl group, octadecenyl group, nonadecenyl group or eicosenyl group, particularly preferred being an alkenyl group having 16 to 19 carbon atoms, such as hexadecenyl group, heptadecenyl group, octadecenyl group or nonadecenyl group.

The component (A) serving as the thickener in the composition of this invention may be prepared by any known process. For example, a diurea compound may be prepared by a single step reaction wherein an amine is reacted with a diisocyanate, and a mixure of diurea, urea-urethane and diurethane compounds may be prepared by a single step reaction wherein an amine and an alcohol are reacted with a diisocyanate. In this reaction, a volatile solvent, such as benzene, toluene, xylene, hexane, naphtha, diisobutyl ether, carbon tetrachloride or petroleum ether, may be used. A lubricant base oil may be added to the reaction mixture as serving as a proper solvent. The reaction temperature may range preferably from 10 to 200° C. In order to prepare a uniform grease composition, the mixture should be stirred to form a sufficiently uniform mixture during the reaction.

The thus prepared thickener is deprived of the volatile solvent when such a solvent is used, and added to a lublicant base oil in a proper amount to produce a grease composition. When a lubricant base oil is used as the solvent, the reaction mixture may be used directly to produce a grease composition.

In the grease composition of this invention, the content of the component (A) serving as the thickener ranges from 2 to 25 wt %, preferably 3 to 20 wt %, based on the total weight of the grease composition. If the content of the component (A) is less than the range as set forth above, the component (A) does not exert satisfactory effect as a thickener, whereas if the content of the component (A) exceeds the range as set forth above, the grease composition becomes too hard to exhibit satisfactory lubricating properties.

The component (B) in the grease composition of this invention is a compound or a mixture of two or more compounds selected from the group consisting of oxidized paraffins, diphenylhydrogen phosphite and hexamethyl phosphoric triamide. Oxidized paraffins include oxidized petroleum waxes, such as paraffin wax or microcrystalline wax, and oxidized synthetic waxes, such as polyethylene wax.

Diphenylhydrogen phosphite is a compound represented by the following formula of:

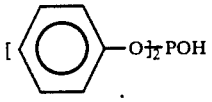

Hexamethyl phosphoric triamide is a compound represented by the formula $[(CH_3)_2N]_3—P{=}O$. By the addition of one or more of the aforementioned compounds, a grease composition excellent in resistance to fretting is obtained.

In the grease composition of this invention, the content of the component (B) ranges within 0.2 to 5.0 wt %, preferably from 0.5 to 4.0 wt %, based on the total weight of the composition. If the content of the component (B) is less than the range set forth above, resistance to fretting of the resultant grease composition is not satisfactory. However, if the content of the component (B) is increased too much beyond the defined range, various properties of the resultant grease composition are adversely affected.

To the grease composition of this invention there may be added other additives without deteriorating the properties thereof to further improve the same. Examples of such additives include another thickener such as a metallic soap, bentone or silica gel, an extreme pressure additive such as chlorine-, sulfur- or phosphor-containing additives or zinc dithiophosphate, an oiliness improver such as a fatty acid, animal oil or vegetable oil, a viscosity index improver such as polymethacrylates, polybutene or polystyrene, an antioxidant such as amines, phenolic compounds, sulfur compounds or zinc dithiophosphate, and an inactivator for metals such as benzotriazole or thiadiazole.

EXAMPLES OF THE INVENTION

The present invention will now be described more specifically with reference to some examples and comparative examples.

Synthesis Example 1

Into 174 g of a mineral oil (@40° C., 100 cSt) added was 8.08 g of diphenylmethane-4,4'-diisocyanate, followed by heating to 60° C. to dissolve uniformly to prepare a frist mixture. Separately, 8.70 g of octadecylamine was mixed with 3.2 g of cyclohexylamine, followed by heating to prepare a second mixture. The second mixture was admixed with the first mixture under vigorous agitation, whereupon a thickened admixture was formed instantaneously. After agitating the admixture at 100° C. for 30 minutes, 6 g of an antioxidant was added and agitated sufficiently and then the thickened mass was passed through a roll mill to obtain a product grease. The ratio of the cyclohexyl group/octadecyl group in the formed diurea compound was 50/50. The content of the thickener was 10 wt %.

Synthesis Example 2

6.96 g of 2,4-2,6-tolylenediisocyanate was added to 100 g of poly-α-olefin oil (@40° C., 44 cSt), and dissolved uniformly at the room temperature to prepare a first mixture. Separately, 1.97 g of cyclohexylamine and 11.10 g of laurylamine were added to the same poly-α-olefin oil to form a second mixture. The second mixture was admixed with the first mixture under vigorous agitation, whereupon a thickened admixture was formed instantaneously. The admixture was allowed to stand for 30 minutes under agitation, and then the temperature thereof was raised to 80° C. and the thickened mass was passed through a roll mill to obtain a product grease. The ratio of the cyclohexyl group/dodecyl group in the formed diurea compound was 25/75. The content of the thickener was 10 wt %.

Synthesis Example 3

11.96 g of bitolylenediisocyanate was added to 180 g of a polyphenyl ether (@40° C., 67 cSt), and dissolved uniformly at 70° C. to prepare a first mixture. Separately, 7.0 g of cyclohexylamine and 1.04 g of octylamine were mixed to form a second mixture. The second mixture was admixed with the first mixture under vigorous agitation, whereupon a thickened admixture was formed instantaneously. The admixture was allowed to stand for 30 minutes under agitation, and then the temperature thereof was raised to 120° C. and the thickened mass was passed through a roll mill to obtain a product grease. The ratio of the cyclohexyl group/octyl group in the formed diurea compound was 90/10. The content of the thickener was 10 wt %.

Synthesis Example 4

Into 120 g of a mineral oil (@40° C., 100 cSt) added was 8.12 g of diphenylmethane-4,4'-diisocyanate, followed by heating to 60° C. to dissolve uniformly to prepare a first mixture. Separately, 6.11 g of octadecylamine, 2.25 g of cyclohexylamine and 3.52 g of dicyclohexylamine were dissolved in 60 g of the same mineral oil, followed by heating to prepare a second mixture. The second mixture was admixed with the first mixture under vigorous agitation, whereupon a thickened admixture was formed instantaneously. After agitating the admixture at 100° C. for 30 minutes, the thickened mass was passed through a roll mill to obtain a product grease. The ratio of the octadecylamino group/cyclohexylamino group/dicyclohexylamino group in the formed diurea compound was 35/35/30. The content of the thickener was 10 wt %.

Synthesis Example 5

40.3 g of 2,4-2,6-tolylenediisocyanate was added to 100 g of a mineral oil (@210° F., 10.5 cSt), and dissolved uniformly at the room temperature to prepare a first mixture. Separately, 32.1 g of cyclohexylamine and 37.6 g of octadecyl alcohol were added to 390 g of the same mineral oil to form a second mixture. The second mixture was admixed with the first mixture under vigorous agitation, whereupon a thickened admixture was formed instantaneously. The admixture was allowed to stand for 30 minutes under agitation, and then the temperature thereof was raised to 100° C. and the thickened mass was passed through a roll mill to obtain a product grease. The ratio of the cyclohexylamino group/octadecyloxy group in the formed urea-urethane compound was 70/30. The content of the thickener was 11 wt %.

Examples 1 to 10 and Comparative Examples 1 to 7

Grease compositions as set forth in Table 1 were prepared by adding components (B) to the base greases obtained by the preceding Synthesis Examples 1 to 5 (Examples 1 to 9). To a commercially available urea grease there was also added the component (B) as set forth in Table 1 (Example 10).

For the comparison purpose, Table 2 shows compositions of greases (Comparative Examples 1 to 5) to which the component (B) was not added, the composition of a grease (Comparative Example 6) composed of a lithium soap grease and, the component (B) and a composition of a commercially available anti-fretting urea grease (Comparative Example 7).

To appraise the properties of these greases, the greases were subjected to the following test. The results of test are shown in Tables 1 and 2.

Test for Appraisal of the Property (Resistance to Fretting)

Generally in accordance with the stipulations set forth in ASTM G-III-12, the properties of the grease compositions were tested using a Fafner Friction Oxidation Tester. The bearing used in the test was #51204, and the time for test was 2 hours.

TABLE 1

| | | Example No. | | | | | | | | | |
|---|---|---|---|---|---|---|---|---|---|---|---|
| | | 1 | 2 | 3 | 4 | 5 | 6 | 7 | 8 | 9 | 10 |
| Base Oil | Kind | Mineral Oil | Mineral Oil | Mineral Oil | Mineral Oil | Mineral Oil | Poly-α-Olefin | Poly-phenyl Ether | Mineral Oil | Mineral Oil | commer-cially Available Urea Grease |
| Kinematic Viscosity* | | 100 | 100 | 100 | 100 | 100 | 44 | 67 | 100 | 100 | |
| Thickener** | | S-1 | S-1 | S-1 | S-1 | S-1 | S-2 | S-3 | S-4 | S-5 | |
| Component (B) (wt %) | Oxidized Paraffin | 0.5 | — | 1.0 | — | 1.0 | — | 0.5 | 0.5 | 1.0 | — |
| | Phosphite (1) | — | 2.0 | — | 2.0 | 1.0 | — | 1.0 | 1.0 | — | 2.0 |
| | Amide (2) | — | — | 2.0 | 2.5 | 1.0 | 4.0 | — | — | 2.0 | 2.5 |
| Property Appraisal Test (mg) | | 1.0 | 0.7 | 1.1 | 0.4 | 0.5 | 1.0 | 0.9 | 0.3 | 0.2 | 0.3 |

Note:
*Kinematic viscosity: @ 40° C., cSt
**Thickener: S-1 = Prepared by Synthesis Example 1, S-2 = Prepared by Synthesis Example 2, S-3 = Prepared by Synthesis Example 3, S-4 = Prepared by Synthesis Example 4, S-5 = Prepared by Synthesis Example 5
Phosphite (1) = Diphenylhydrogen phosphite, Amide (2) = Hexamethyl phosphoric triamide

TABLE 2

| | | Comparative Example | | | | | | |
|---|---|---|---|---|---|---|---|---|
| | | 1 | 2 | 3 | 4 | 5 | 6 | 7 |
| Base Oil | Kind | Mineral Oil | Poly-α-Olefin | Poly-phenyl Ether | Mineral Oil | Mineral Oil | Mineral Oil | Commer-cially Available Anti-Fretting Urea Grease |
| Kinematic Viscosity* | | 100 | 44 | 67 | 100 | 100 | 100 | |
| Thickener** | | S-1 | S-2 | S-3 | S-4 | S-5 | Lithium Soap | |
| Component (B) (wt %) | Oxidized Paraffin | — | — | — | — | — | 3.0 | |

TABLE 2-continued

| | Comparative Example | | | | | | |
|---|---|---|---|---|---|---|---|
| | 1 | 2 | 3 | 4 | 5 | 6 | 7 |
| Phosphite (1) | — | — | — | — | — | 4.0 | |
| Amide (2) | — | — | — | — | — | 3.5 | |
| Property Appraisal Test (mg) | 8.9 | 7.8 | 10.1 | 9.8 | 7.0 | 6.5 | 2.0 |

Note:
*Kinematic viscosity: @ 40° C., cSt
**Thickener: S-1 = Prepared by Synthesis Example 1, S-2 = Prepared by Synthesis Example 2, S-3 = Prepared by Synthesis Example 3, S-4 = Prepared by Synthesis Example 4, S-5 = Prepared by Synthesis Example 5
Phosphite (1) = Diphenylhydrogen phosphite, Amide (2) = Hexamethyl phosphoric triamide As will be apparent from the results set forth in Table 1, the compositions prepared by Examples 1 to 10 of the present invention exhibit improved resistance to fretting. In contrast thereto, as shown in Table 2, the grease compositions which do not contain the component (B) (Comparative Examples 1 to 5) and the grease composition in which a lithium soap is used in placed of the component (A) (Comparative Example 6) are significantly inferior to the compositions of this invention in resistance to fretting. The grease compositions of this invention have appreciably improved resistance to fretting over that of a commercially available grease composition (comparative Example 7) which is pronounced to be improved in resistance to fretting.

As should be understood from the foregoing, the present invention provides a grease composition which is improved in resistance to fretting.

Although the present invention has been described with reference to the specific examples, it should be understood that various modifications and variations can be easily made by those skilled in the art without departing from the spirit of the invention. Accordingly, the foregoing disclosure should be interpreted as illustrative only and is not to be interpreted in a limiting sense. The present invention is limited only by the scope of the following claims.

What is claimed is:

1. A grease composition comprising:

a base oil selected from the group consisting of mineral lubricant base oils, synthetic lubricant base oils and mixtures thereof;

(A) 2 to 25 wt %, based on the total weight of the composition, of a thickener for use in the grease composition selected from the group consisting of diurea compounds, triurea compounds, tetraurea compounds, polyurea compounds, urea-urethane compounds, diurethane compounds and mixtures thereof; and (B) 0.? and 5.0 wt %, based on the total weight of the composition, of an ingredient selected from the group consisting of oxidized paraffins, diphenylhydrogen phosphite, hexamethyl phosphoric triamide and mixtures thereof.

2. The grease composition according to claim 1, wherein said mineral lubricant base oils are selected from the group consisting of SAE 10, SAE 20, SAE 30, SAE 40, SAE 50, bright stock and mixtures thereof.

3. The grease composition according to claim 1, wherein said synthetic lubricant base oils are selected from the group consisting of α-olefin oligomers, alkylbenzenes, alkylnaphthalenes, diesters, polyol esters, polyglycols, polyphenyl ether, tricresyl phosphate, silicone oil, perfluoroalkyl ether and mixtures thereof.

4. The grease composition according to claim 1, wherein said synthetic lubricant base oils are selected from the group consisting of normal paraffin, isoparaffin, polybutene, polyisobutyrene, 1-decene oligomer, monoalkylbenzene, dialkylbenzene, polyalkylbenzenes, monoalkylnaphthalene, dialkylnaphthalene, polyalkylnaphthalene, di-2-ethylhexyl sebacate, dioctyl adipate, diisodecyl adipate, ditridecyl adipate, ditridecyl glutarate, trimethylolpropane caprylate, trimethylolpropaneperalgonate, pentaerythritol-2-ethyl hexanoate, pentaerythritol pelargonate, polyethyleneglycol, polyethyleneglycol monoether, polypropyleneglycol, polypropyleneglycol monoether and mixtures thereof.

5. The grease composition according to claim 1, wherein a viscosity of said base oil ranges within 10 to 200 cSt at 40° C.

6. The grease composition according to claim 1, wherein said thickener is a mixture comprising at least one of diurea compounds represented by the following formula:

$$R_2-NH\overset{O}{\overset{\|}{C}}NH-R_1-NH\overset{O}{\overset{\|}{C}}NH-R_3$$

wherein $R_1$ represents a difunctional aromatic hydrocarbon residue having 6 to 15 carbon atoms;

the content of said cyclohexyl group or said group derived from a cyclohexyl, represented by ×100, ranging within 20 to 90%; and the content of the diurea compound wherein $R_2$ is a cyclohexyl group or a group derived from the cyclohexyl and $R_3$ is an alkyl group or an alkenyl group being not less than 10 mol %.

7. The grease composition according to claim 6, wherein said $R_1$ is selected from the group consisting of

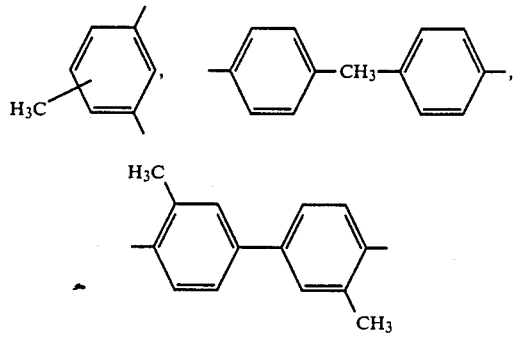

and mixtures thereof.

8. The grease composition according to claim 6, wherein said group derived from the cyclohexyl having 7 to 12 carbon atoms is selected from the group consisting of methylcyclohexyl group, dimethylcyclohexyl group, ethylcyclohexyl group, diethylcyclohexyl group, propylcyclohexyl group, isopropylcyclohexyl group, 1-methyl-3-propylcyclohexyl group, butylcyclohexyl group, amylcyclohexyl group, amylmethylcyclohexyl group, hexylcyclohexyl group and mixtures thereof.

9. The grease composition according to claim 6, wherein said alkyl group having 8 to 20 carbon atoms is selected from the group consisting of octyl group, nonyl group, decyl group, undecyl group, dodecyl group, tridecyl group, tetradecyl group, pentadecyl group, hexadecyl group, heptadecyl group, octadecyl group, nonadecyl group, eicosyl group and mixtures thereof.

10. The grease composition according to claim 6, wherein said alkenyl group having 8 to 20 carbon atoms is selected from the group consisting of octenyl group, nonenyl group, decenyl group, undecenyl group, dodecenyl group, tridecenyl group, tetradecenyl group, pentadecenyl group, hexadecenyl group, heptadecenyl group, octadecenyl group, nonadecenyl group, eicosenyl group and mixtures thereof

11. The grease composition according to claim 1, wherein said thickener is a mixture of at least two diurea compounds represented by the formula:

$$A-\overset{\overset{\displaystyle O}{\|}}{C}NH-R_4-NH\overset{\overset{\displaystyle O}{\|}}{C}-B$$

wherein $R_4$ stands for a difunctional aromatic hydrocarbon residue having 6 to 15 carbon atoms;

A and B may be the same or different and each stands for either one of a first amino group represented by the formula of $R_5$—NH— where $R_5$ is selected from the group consisting of a cyclohexyl group, a group derived from the cyclohexyl and having 7 to 12 carbon atoms or an alkyl or alkenyl group having 8 to 20 carbon atoms, and a second amino group represented by the formula of $$\begin{matrix} R_6 & \\ & \diagup N- \\ R_7 & \end{matrix}$$

wherein $R_6$ and $R_7$ may be the same or different and each stands for a cyclohexyl group or a group derived from the cyclohexyl and having 7 to 12 carbon atoms;

the content of said second amino group in said thickener, represented by ranging within 1 to 50%; and the ratio between said first amino group wherein $R_5$ is a cyclohexyl group or a group derived from the cyclohexyl and said first amino group wherein $R_5$ is an alkyl group ranging from ¼ to 4/1.

12. The grease composition according to claim 11, wherein said $R_4$ is selected from the group consisting of

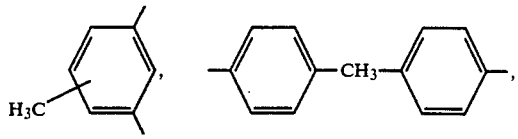

-continued

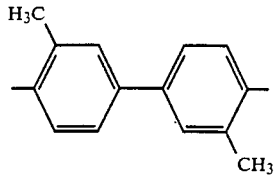

and mixtures thereof.

13. The grease composition according to claim 11, wherein said group derived from the cyclohexyl having 7 to 12 carbon atoms is selected from the group consisting of methylcyclohexyl group, dimethylcyclohexyl group, ethylcyclohexyl group, diethylcyclohexyl group, propylcyclohexyl group, isopropylcyclohexyl group, 1-methyl-3-propylcyclohexyl group, butylcyclohexyl group, amylcyclohexyl group, amylmethylcyclohexyl group, hexylcyclohexyl group and mixtures thereof.

14. The grease composition according to claim 11, wherein said alkyl group having 8 to 20 carbon atoms is selected from the group consisting of octyl group, nonyl group, decyl group, undecyl group, dodecyl group, tridecyl group, tetradecyl group, pentadecyl group, hexadecyl group, heptadecyl group, octadecyl group, nonadecyl group, eicosyl group and mixtures thereof.

15. The grease composition according to claim 11, wherein said alkenyl group having 8 to 20 carbon atoms is selected from the group consisting of octenyl group, nonenyl group, decenyl group, undecenyl group, dodecenyl group, tridecenyl group, tetradecenyl group, pentadecenyl group, hexadecenyl group, heptadecenyl group, octadecenyl group, nonadecenyl group, eicosenyl group and mixtures thereof.

16. The grease composition according to claim 1, wherein said thickener comprises a urea-urethane mixture having a composition including 20 to 95 mol % of a diurea compound represented by the formula (1) of:

$$R_9NH-\overset{\overset{\displaystyle O}{\|}}{C}NH-R_8-NH\overset{\overset{\displaystyle O}{\|}}{C}-NHR_{10} \qquad (1)$$

4 to 30 mol % of a urea-urethane compound represented by the formula (2) of:

$$R_{12}NH-\overset{\overset{\displaystyle O}{\|}}{C}NH-R_{11}-NH\overset{\overset{\displaystyle O}{\|}}{C}-OR_{13} \qquad (2)$$

and 1 to 50 mol % of a diurethane compound represented by the formula (3) of:

$$R_{15}O-\overset{\overset{\displaystyle O}{\|}}{C}NH-R_{14}-NH\overset{\overset{\displaystyle O}{\|}}{C}-OR_{16} \qquad (3)$$

wherein $R_8$, $R_{11}$ and $R_{14}$ may be the same or different and each represents a difunctional aromatic hydrocarbon residue having 6 to 15 carbon atoms, $R_9$, $R_{10}$ and $R_{12}$ may be the same or different and each represents a cyclohexyl group or a group derived from the cyclohexyl and having 7 to 12 carbon atoms, and $R_{13}$, $R_{15}$ and $R_{16}$ may be the same or different and each represents an alkyl or alkenyl group having 8 to 20 carbon atoms, the ratio of the number of amino groups $R_9NH$—, $R_{10}NH$— and $R_{12}NH$— to the number of alkoxy groups $R_{13}O$—, $R_{15}O$— and $R_{16}O$— in said mixture being 95/5 to 40/60.

17. The grease composition according to claim 16, wherein said $R_8$, $R_{11}$ and $R_{14}$ are selected from the group consisting of

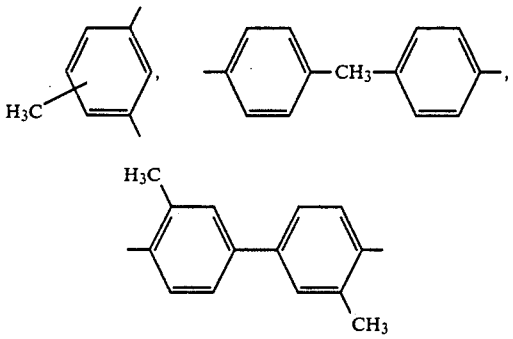

and mixtures thereof.

18. The grease composition according to claim 16, wherein said group derived from the cyclohexyl having 7 to 12 carbon atoms is selected from the group consisting of methylcyclohexyl group, dimethylcyclohexyl group, ethylcyclohexyl group, diethylcyclohexyl group, propylcyclohexyl group, isopropylcyclohexyl group, 1-methyl-3-propylcyclohexyl group, butylcyclohexyl group, amylcyclohexyl group, amylmethylcyclohexyl group, hexylcyclohexyl group and mixtures thereof.

19. The grease composition according to claim 16, wherein said alkyl group having 8 to 20 carbon atoms is selected from the group consisting of octyl group, nonyl group, decyl group, undecyl group, dodecyl group, tridecyl group, tetradecyl group, pentadecyl group, hexadecyl group, heptadecyl group, octadecyl group nonadecyl group, eicosyl group and mixtures thereof.

20. The grease composition according to claim 16, wherein said alkenyl group having 8 to 20 carbon atoms is selected from the group consisting of octenyl group, nonenyl group, decenyl group, undecenyl group, dodecenyl group, tridecenyl group, tetradecenyl group, pentadecenyl group, hexadecenyl group, heptadecenyl group, octadecenyl group, nonadecenyl group, eicosenyl group and mixtures thereof.

21. The grease composition according to claim 1, wherein said oxidized paraffins are selected from the group consisting of oxidized petroleum waxes, oxidized synthetic waxes and mixtures thereof.

* * * * *

UNITED STATES PATENT AND TRADEMARK OFFICE

CERTIFICATE OF CORRECTION

PATENT NO. : 5,043,085

DATED : AUGUST 27, 1991

INVENTOR(S) : Hirotugu Kinoshita, et al.

It is certified that error appears in the above-identified patent and that said Letters Patent is hereby corrected as shown below:

Title page, item (73) Assignee, should read --Nippon Oil Co., Ltd.--.

Column 9, line 52, in Claim 1: replace "and" with --to--

Column 10, lines 22-23, in Claim 4: replace "trimethylolpropaneperalgonate" with --trimethylolpropane peralgonate--

Column 10, line 41, in Claim 6: insert --and $R_2$ and $R_3$ may be the same or different and each stands for a cyclohexyl group, a group derived from the cyclohexyl and having 7 to 12 carbon atoms or an alkyl or alkenyl group having 8 to 20 carbon atoms;-- after line 40

Column 10, line 42, in Claim 6: replace "a" with --the--

Column 10, line 42, in Claim 6: insert --((number of said cyclohexyl groups or said groups derived from the cyclohexyl)/(number of said cyclohexyl groups or said groups derived from the cyclohexyl plus number of said alkyl groups or said alkenyl groups))-- after "by"

Column 11, line 53, in Claim 11: insert --((number of the second amino groups/number of the first amino groups plus number of the second amino groups) x 100)-- after "by"

UNITED STATES PATENT AND TRADEMARK OFFICE

CERTIFICATE OF CORRECTION

PATENT NO. : 5,043,085

DATED : August 27, 1991

INVENTOR(S) : Hirotugu Kinoshita, et al.

It is certified that error appears in the above-identified patent and that said Letters Patent is hereby corrected as shown below:

Column 14, line 13, claim 19, insert --,-- after first "group".

Signed and Sealed this

Twelfth Day of January, 1993

*Attest:*

DOUGLAS B. COMER

*Attesting Officer*

*Acting Commissioner of Patents and Trademarks*